United States Patent [19]

Fouche, Jr.

[11] 4,187,332

[45] Feb. 5, 1980

[54] PROCESS FOR PRODUCING LIGHT-REFLECTIVE FABRICS

[75] Inventor: Glynn E. Fouche, Jr., Spartanburg, S.C.

[73] Assignee: M. Lowenstein & Sons, Inc., New York, N.Y.

[21] Appl. No.: 952,781

[22] Filed: Oct. 19, 1978

[51] Int. Cl.[2] ..... G02B 5/12; D06C 29/00; B29D 9/08; B32B 17/12

[52] U.S. Cl. ..... 427/47; 264/1; 264/24; 264/108; 427/130; 427/131; 427/163; 427/215; 427/269; 427/375; 428/900

[58] Field of Search ..... 264/1, 2, 24, 108; 427/47, 128, 130, 131, 163; 428/900

[56] References Cited

U.S. PATENT DOCUMENTS

| | | | |
|---|---|---|---|
| 2,467,214 | 4/1949 | Luaces | 264/24 |
| 2,581,549 | 1/1952 | McGaugh | 88/80 |
| 2,584,441 | 2/1952 | Fridendall | 264/108 |
| 3,218,186 | 11/1965 | De Vries | 264/1 |
| 3,377,184 | 4/1968 | Kukoff . | |
| 3,428,514 | 2/1969 | Greer et al. . | |
| 3,535,019 | 10/1970 | Longlet et al. | 350/105 |
| 3,676,273 | 7/1972 | Graves | 264/108 |

*Primary Examiner*—James B. Lowe

*Attorney, Agent, or Firm*—Luke J. Wilburn, Jr.; Wellington M. Manning, Jr.

[57] ABSTRACT

An improved process for producing durable, wash resistant, light-reflective fabrics for use in garments and wearing apparel to enhance their nighttime visibility without significantly detracting from the daytime visual appearance of the fabrics, comprising the steps of applying to a surface of a textile fabric constructed from differentially dyed or dyeable yarns or fibers a liquid paste composition containing a uniform dispersion of binder-coated, reflex-reflective, magnetically orientable particles suspended therein, and a carboxyvinyl polymeric thickener in the composition to maintain a composition viscosity of between about three thousand to seventeen thousand centipoise, applying a magnetic force field to the fabric to magnetically orient the particles in the paste composition to dispose their light-reflective surfaces generally outwardly from the surface of the fabric, treating the fabric to activate the binder of the particles and adhesively secure the particles to the fabric surface, and subsequently treating the fabric with a finishing composition to enhance the durability of the reflective particles on the fabric and improve their resistance to removal by washing. The liquid paste composition containing the uniformly disbursed reflective particles is particularly suited for application to the fabrics by a screen printing or coating operation.

11 Claims, 2 Drawing Figures

PROCESS FOR PRODUCING LIGHT-REFLECTIVE FABRICS

The present invention is directed to the manufacture of light-reflective textile fabrics for use in garments and other wearing apparel to provide improved night visibility of persons wearing such garments and wearing apparel to motorists, and, more particularly, to a method of producing improved, light-reflective fabrics by incorporating reflex-reflective particles therein such that the fabrics provide improved reflex-reflectivity in nighttime viewing, and without significantly detracting from the daytime appearance or other aesthetic properties of the fabrics.

BACKGROUND OF THE INVENTION

It has long been known that the night visibility of pedestrians and other persons in the area of automobile traffic is greatly improved to motorists by the wearing of light-reflective clothing. It is known that the visibility of garments and wearing apparel at night can be enhanced by sewing reflective bands or strips into the garments, and by incorporating light-reflective particles into fabrics from which the garments are made.

Light-reflective properties of various substrate materials, such as fabrics, have heretofore been enhanced by coating or laminating the materials with a layer of reflex-reflective glass microspheres, or beads. Such microspheres are commercially available and generally comprise small spherical glass beads which are hemispherically coated with a thin film of light-reflective metal, such as aluminum, and an overlying resinous binder of thermoplastic material. Typically, such reflex-reflective glass bead coatings are produced by uniformly applying glass microspheres to an adhesively coated carrier sheet, and then coating their exposed hemispheric surfaces with the reflective metal and the thermoplastic binder.

It has been a practice to then laminate the binder-coated face of such reflex-reflective sheet to a fabric substrate, with application of heat to activate the binder and bond it to the fabric surface. The carrier sheet is then stripped from the glass bead layer to produce a resultant fabric product having a mono-layer of reflex-reflective beads on the fabric surface, with the beads uniformly oriented to expose their hemispherically reflective surfaces away from the fabric surface for optimum light reflectance. U.S. Pat. Nos. 3,164,645; 3,172,942; and 3,758,192 are illustrative of such a manner of producing reflex-reflective glass bead sheets, and the methods of laminating such glass bead sheets to fabric substrates.

Although such coated fabrics exhibit improved light reflectivity, there are certain disadvantages for their manufacture and use in garments and wearing apparel. Since conventional textile fabric finishing operations generally do not utilize laminating equipment, the expense of acquiring and operating such equipment adds to the cost of manufacture of the fabrics. More importantly, it is believed that a laminated coating layer of glass beads on the fabric surface decreases fabric drapability and flexibility and resultant wear comfort of garments made therefrom. Such coatings of glass beads also appreciably alters and detracts from the normal daytime visual appearance of the garments and causes an off-color or dingy appearance of the fabrics, making garments produced therefrom often aesthetically unattractive for normal daytime wear.

More recently, it has been proposed to incorporate reflex-reflective glass beads into textile fabrics by a dry particle method of application wherein reflex-reflective beads having a magnetizable component in their hemispheric coating are applied in discrete particle form to the surface of the fabric, and thereafter the fabric is subjected to a magnetic force field to orient the light-reflective surfaces of the beads outwardly of the fabric before activation of the binder resin. Attempts to utilize such a dry method application of the magnetizable glass beads in commercial textile fabric manufacturing operations have not proved satisfactory for several reasons.

First, conventional textile fabric manufacturing and finishing operations do not have available the necessary equipment for dry application of reflective bead incorporation into the fabrics; therefore, the purchase and installation of additional equipment not commonly used or readily available in textile dyeing and finishing plants adds appreciably to the cost of manufacturing. Second, attempts to employ a dry method of application of the reflective beads has shown that, for textile fabrics, uniform metering and application of the particles on the fabric is difficult in a continuous production line operation, and the particles often become located within the interstices of the fabric before they can be properly oriented and fixed by activation of the thermoplastic binder to the fabric. Thus, a large portion of the effective light reflectance of the beads may be lost due to improper location and orientation of the beads adjacent the fabric surface. In addition, attempts to fix the glass particles via their thermoplastic binder in a dry application have not yielded satisfactory levels of durability of the particles on the fabric under laundering conditions to which garments made therefrom are subjected.

Thus, although reflex-reflective particles are readily available for improving light reflectivity of various articles and substrates, I know of no satisfactory economical method of applying the particles in a commercial textile finishing operation.

U.S. Pat. No. 3,535,019 discloses a liquid composition having reflex-reflective elements, i.e., glass microspheres which are hemispherically metallized to have a specular-reflecting, hemispherical surface, which composition is suggested be applied to a fabric in a desired pattern by screen printing or spraying. However, it is believed that such paintlike coatings applied to fabrics generally stiffen the fabrics in the area of application, and interfere with the drape and comfort of garments made from the fabrics during wear. Problems also exist when applying such reflex-reflective glass spheres to fabrics to orient the spheres so that their light-reflective surfaces face outwardly of the surface of the fabric to provide optimum light-reflectivity with minimum application of the glass particles.

OBJECTS OF THE INVENTION

It is therefore an object of the present invention to provide an improved method for producing light-reflective fabrics by incorporation therein of reflex-reflective glass particles of the type described which overcome the disadvantages of the prior art.

It is another object of the present invention to provide an improved method for producing durable, wash-resistant, reflex-reflective fabrics for use in garments and the like to enhance nighttime visibility without significantly detracting from the daytime appearance of the fabrics, and with use of conventional textile finishing apparatus and equipment available in the textile industry.

It is another object to provide an improved process for producing light-reflective fabrics wherein the surface of the fabrics are uniformly coated with a liquid paste composition comprising an aqueous dispersion of reflex-reflective glass bead particles having magnetizable components therein, with application of a magnetic force-field to the paste-containing fabrics to magnetically orient the reflex-reflective particles in proper position prior to their fixation on the fabric to obtain maximum light reflectivity with minimum use of reflective beads.

DESCRIPTION OF THE INVENTION

In its broad aspects, the present invention is directed to an improved process for producing durable, wash-resistant, light-reflective fabrics for use in garments and wearing apparel to enhance their nighttime visibility without significantly detracting from their daytime visual appearance, comprising the steps of applying to a surface of textile fabric constructed from differentially dyed or dyeable yarns or fibers, a liquid paste composition containing a uniform dispersion of binder-coated, reflex-reflective magnetically orientable glass microsphere particles suspended therein, and a carboxyvinyl polymeric thickner in the composition to maintain a composition viscosity of between about three thousand to seventeen thousand centipoise, applying a magnetic force-field to the fabric to magnetically orient the particles in the paste composition and expose their light-reflective surfaces generally outwardly of the surface of the fabric, treating the fabric to activate the binder on the particles and adhesively secure them to the fabric surface, and subsequently treating the fabric with a finishing composition to enhance durability of the reflective particles on the fabrics and improve resistance to removal by washing.

In carrying out the process of the present invention, it is desirable, for minimum detraction from the daytime visual appearance of the fabric, that a minimum amount of reflective particles be incorporated into the fabrics to provide the light-reflectivity desired. In this regard, it is extremely important that the reflex-reflective particles be properly oriented to provide optimum light reflectivity. It is further desirable that the reflective glass bead particles be located closely adjacent the fabric surface so as not to be hidden from optimum reflectivity by the yarns and fibers of the fabric itself. Thus, a coating paste viscosity of a between about three thousand to seventeen thousand centipoise has been found to maintain the particles adjacent the fabric surface, rather than in the interstices of the fabric, while permitting proper orientation of the particles upon the application of a magnetic force field. Optimum results have been found to be obtained with paste viscosities of between about 8,000–13,000 centipoise. If the viscosity is too low, the particles tend to locate themselves too deeply in the fabric interstices, whereas if the viscosity is too high, the glass particles are not susceptible to ready reorientation in proper light-reflecting position under infuence of a magnetic force field.

It has further been found that efficiency of magnetic reorientation and better orientation of the reflex-reflective particles in the paste composition for light-reflectance may be accomplished by use of a surface active agent in the composition to lower the surface tension of the composition.

To properly "mask" or "hide" the appearance of the glass spheres in the fabric and not appreciably detract from the daytime visual appearance of the fabrics, it has been found that such can be accomplished by utilizing differentially dyed or dyeable fibers or yarns in the fabric construction. Particularly good results have been obtained by the use of denim fabrics, i.e., fabric where the warp and fill yarns are of different coloration, and by cross dyeing polyester/cotton fabrics to selected shades which effectively camouflage the particles under daylight or indoor viewing conditions.

In addition, it has been found that fabrics made in accordance with the present invention exhibit improved durability and resistance to home launderings by finishing the fabrics, after incorporation of the reflex-reflective particles, with particularly selected resin formulations to enhance the durability of the particles on the fabric. Such finish formulations must not detract from the reflex-reflectivity of the particles in the fabric, but must provide durability without significant loss of light reflectance of the particles. To accomplish these ends, it has been found that finishing formulations containing fluorocarbon chemicals provide optimum durability of the particles in the fabrics without adversely affecting their light-reflective characteristics.

The process of the present invention is directed to the incorporation of reflex-reflective glass particles having magnetizable components in a suitable binder to uniformly incorporate them into fabric materials to improve their light-reflectivity. Such particles which have been found to provide particularly satisfactory results are those commercially available under the trade name "SCOTCHLITE" Brand Reflective Particles 6110 sold by Minnesota Mining and Manufacturing Company. It has been found that superior results in light-reflectivity of the fabrics can be obtained by employing such reflective particles having an average particle size range of between about 200 to 400 microns.

Although the paste composition containing uniformly dispersed reflex-reflective particles may be continuously applied to a surface of a textile fabric by a coating operation, the composition is particularly suited for a uniform application by use of conventional textile screen printing equipment having uniformly dispersed openings throughout the screen. For best results in uniformity of application of the particles, it has been found that the screen openings are preferably between about one and a half to three times the size of the average particle size of the reflective particles to be incorporated into the fabric. For example, for an average reflective particle size of between about 200 to 400 microns (80 to 100 mesh), screen openings of between about 25 to 70 mesh may be employed. Both flat bed and rotary screen type printing apparatus are well suited for application of the paste to the fabric surface.

Details of the invention will be better understood and explained by reference to the accompanying drawing and following specific examples which illustrate a manner of carrying out the invention in a commercial textile finishing operation.

Figure 1:
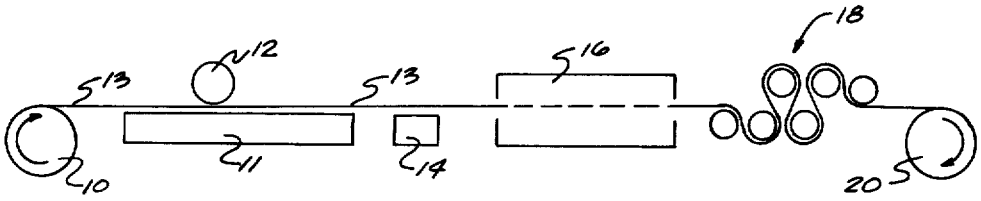
FIG. 1 illustrates schematically a conventional textile screen printing range for printing textile fabrics which has been modified to carry out the process of the present invention.

FIG. 1 illustrates schematically the component steps of the operation on a continuous basis wherein a cross-dyed fabric from a supply roll 10 is continuously directed through a conventional rotary screen printing apparatus 11 wherein the paste composition containing the light-reflective particles is uniformly applied across the surface of the fabric through uniformly dispersed openings of the rotary screen 12 of the printing apparatus. The fabric 13 leaving the screen printer in wet condition is subjected to a magnetic force field by means of an orienting magnet 14 located beneath the path of travel of the fabric and extending across the width of the fabric. The force field is uniform across the width of the fabric and is unidirectional to obtain and maintain proper particle orientation as the wet fabric passes thereover. Typically, a magnetic field of between about 400 to 1200 gauss in intensity has been found to provide satisfactory results in orienting the magnetizable reflective particles with their hemispherical reflective surfaces directed upwardly away from the surface of the fabric.

After orientation of the light-reflective particles, the fabric is passed through a hot air drying oven 16 where it is initially heated to a temperature sufficient to react the thermoplastic binder of the reflective particles with the fabric surface to partially fix them thereto. Partial fixation of the reflective particles on the fabric has been found to be achieved by maintaining the fabrics in the drying oven set at a temperature of 350°-400° F. for approximately one minute. Such partial fixation with hot air maintains the position of the particles prior to their subsequent final fixation on heated drying cylinders, illustrated at 18. The drying cylinders provide optimum fixation at temperatures of approximately 350°-400° F. with a 60 to 90 second contact time of the fabric on the cylinders.

Following fixation, the fabric is collected on a roll 20 and subsequently subjected to finishing operations with selected formulations to enhance the durability of the particles to multiple home laundering and drying cycles.

The following specific examples illustrate a manner of practicing the present invention in a commercial textile finishing operation. Percentages are by weight unless otherwise indicated.

EXAMPLE I

A 65% polyester/35% cotton poplin woven fabric having a fabric weight of 6 ozs. per square yard is conventionally cross-dyed with the following dye formulation:

Dye Formulation:

| Component | Amount % by Weight | Supplier |
|---|---|---|
| Vircon ACP (dyeing assistant) | 0.25 | Virkler Chemical Co. |
| Quadrofos (dyeing assistant and water softener) | 0.20 | Moreland Chemical Co. |
| Acetic acid for pH of 6-6.5 | | Monsanto |
| Bellamine Black OBX | 0.35 | Allied Chemical Corp. |
| Atlantic Blue RULM | 0.40 | Atlantic Dyestuff |
| Water | 98.80 | |

The cross-dyed fabric is thereafter continuously processed through a textile printing range of the type shown in FIG. 1 where a paste composition containing uniformly dispersed reflex-reflective particles is uniformly applied to the upper surface of the fabric to obtain an 80% wet pick-up based on the dry weight of the fabric. The paste composition having a viscosity of 12,000 centipoise is applied to the fabric by a Stork rotary screen print machine using a 30 mesh screen and the reflex-reflective particles in the composition have an average particle size range of 300-400 microns. The paste composition has the following formulation:

Paste Formulation

| Component | Amount % by Weight | Supplier |
|---|---|---|
| Acramin SNS Concentrate (carboxyvinyl polymer thickner) | 2.35 | Verona Dyestuff Co. |
| 3M 6110 Reflective Particles | 2.0 | Minn. Min. & Mfg. Co. |
| Water | 95.65 | |

The wet fabric leaving the printing range is passed over an orienting magnet where the fabric containing the paste composition is subjected to a unidirectional magnetic force field of 1,000-1,200 gauss to orient the magnetizable reflective particles in the paste composition with their reflex-reflective surfaces directed upwardly away from the fabric surface.

The fabric is thereafter immediately passed through a forced hot air drying oven maintained at a temperature of 380°-400° F. for approximately 60 seconds to fuse the thermoplastic binder on the lower hemisphere of the reflective particles and affix them to the fabric surface, after which the fabric is passed over a series of heated rolls having a temperature of 360°-380° F. for approximately 70 seconds to force the thermoplastic binder into the fabric structure and firmly bond the reflective particles to the fabric surface.

The fabric leaving the heated rolls is batched on rolls and thereafter subjected to a wet finishing treatment with the following finish composition:

Finish Formulation

| Component | Amount % by Weight | Supplier |
|---|---|---|
| Resin 2309 (N-methylol polymer) | 8.0 | BASF |
| Catalyst KL (Zinc Nitrate Catalyst) | 1.2 | Minerals Reseach Co. |
| Zepel K (Fluoropolymer dispersion in $H_2O$) | 3.0 | E.I. duPont |
| Aerotex Water Repellent 96 (water repellent and fluorochemical extender) | 3.0 | American Cyanamid |
| Protowet PWR | 0.2 | Moretex Chemical Co. |

EXAMPLE II

A 100% cotton denim having a fabric weight of 8 ozs. per square yard and warp yarn dyed with indigo dyestuff is uniformly screen printed on the screen printing range as in Example I to an 80% wet pick-up with a paste composition having a viscosity of 12,000 centipoise and the following composition:

| Paste Formulation | | |
|---|---|---|
| Component | Amount % by Weight | Supplier |
| Acramin SNS Conc. | 2.35 | Verona Dyestuff Co. |
| 6110 Reflective Particles | 2.25 | 3M Company |
| Triton X-100 (surface active agent) | 0.25 | Rohm & Haas Co. |
| Water | 95.35 | |

The paste-containing fabric is passed over an orienting magnet and heated as in Example I to affix the magnetically oriented particles to the fabric and thereafter subjected to a wet finishing treatment with the following finish composition:

| Finish Formulation | | |
|---|---|---|
| Component | Amount % by Weight | Supplier |
| Resin 901 Aerotex glyoxyl-base | 8.00 | American Cyanamid |
| Catalyst MG | 3.50 | Mineral Research Co. |
| Softenall 200 | 4.00 | Allison Chemical |
| Protowet PWR | .20 | Moretex Chemical |
| Water | 84.30 | |

EXAMPLE III

A 65% polyester, 35% cotton woven fabric having a weight of 6 ozs. per square yard was prepared with the polyester fibers only dyed with the following dye formulation:

| Dye Formulation | | |
|---|---|---|
| Component | Amount % by Weight | Supplier |
| Foron Blue SBGL | 1.90 | Sandoz Dyestuff |
| Polydye Red RBSF | .17 | Inmont Chemical |
| Sodecron Black BK | .74 | Southern Dyestuff |
| Water | 97.19 | |

The dyed fabric was treated as in Example I to uniformly apply by screen printing a paste composition of the following formulation to obtain a wet pick-up of 80% on the fabric. The reflective particles were magnetically oriented and affixed to the fabric as in Example I, and the fabric was thereafter finished by application of the following finishing composition:

| Finish Formulation | | |
|---|---|---|
| Component | Amount % by Weight | Supplier |
| Resin 2309 | 8.00 | BASF |
| Catalyst KL | 1.20 | Mineral Research Co. |
| Softenall 200 | 3.00 | Allison Chemical |
| Water | 87.80 | |

Figure 2:
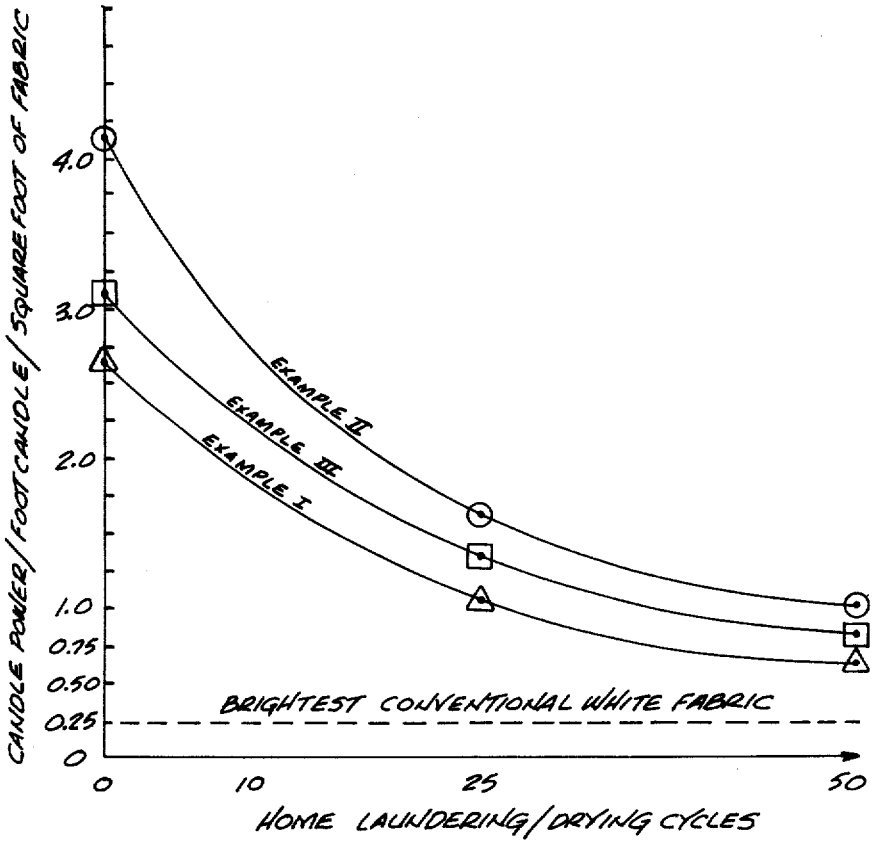
FIG. 2 is a graph illustrating the comparative light-reflectance properties and wash durability of fabrics manufactured in accordance with Examples I-III of the present invention hereinafter described.

The dry final fabrics of Examples I–III containing reflex-reflective particles uniformly dispersed and secured thereto in an amount of 2.72, 4.09, and 3.07 grams of particles per square yard of fabric, respectively, were tested for light reflectance in accordance with Federal Test Method Standard 370 (0.2° Observation Angle, −4.0° Entrance) and exhibited excellent light reflectivity and retention thereof after repeated home laundering cycles as compared to conventional white fabrics, as indicated in the graph of FIG. 2.

As best shown in FIG. 2, which is a graph indicating the reflective brightness retention of each of the fabrics of Examples I–III, each of the fabrics was tested for brightness in accordance with U.S. Federal Test Method Standard 370 utilizing a source of illumination directed against the reflective fabric surface at a minus 4° entrance angle from an axis normal to the plane of the reflective fabric surface, and a photo receiver set at a plus 0.2° observation angle from the plane of the fabric surface. At an illumination and observation distance of 50 feet, the reflective brightness retention of the three fabrics were tested after 0, 25, and 50 home laundering and drying cycles, and the results compared to a conventional white fabric without reflective particle treatment. Test results were measured in terms of candlepower per footcandle per square foot of fabric surface. As can be seen from FIG. 2, after 50 home launderings, all of the fabrics of Exhibits I–III exhibited greater reflective brightness than untreated conventional white fabric.

Garments made from the fabrics of Examples I–III exhibited little, if any, change in normal fabric appearance under daylight and indoor lighting conditions since the cross-dyed effect camouflaged the reflective particles.

That which is claimed is:

1. A method of producing light-reflective fabrics comprising the steps of:

(a) providing a textile fabric constructed of differentially dyed or dyeable yarns or fibers;

(b) applying to a surface of said fabric a liquid paste composition comprising an aqueous dispersion of reflex-reflective glass bead particles having a substantially hemispheric coating of a magnetizable component in an activatable binder, said paste composition including a carboxyvinyl polymeric thickner to provide a viscosity of the composition of between about 3,000 to 17,000 centipoise;

(c) applying a directional magnetic force field to the composition containing fabric to magnetically orient the reflex-reflective glass bead particles in said paste composition and dispose their reflex-reflective surfaces of the bead particles outwardly of the surface of the fabric;

(d) activating the binder of the particles to adhesively secure them to said fabric surface; and (e) subsequently treating the fabric with a textile finishing composition to increase the durability and resistance of the glass bead particles thereon to removal by washing.

2. A method as defined in claim 1 wherein said liquid paste composition is applied to the surface of the fabric by screen printing the composition thereon.

3. A method as defined in claim 2 wherein the liquid paste composition has a viscosity of between about 8,000 to 13,000 centipoise.

4. A method as defined in claim 1 wherein said binder of said reflex-reflective glass bead particles is a thermoplastic binder, and wherein said bead particles are heated to fuse said thermoplastic binder and adhesively secure said particles to the fabric surface.

5. A method as defined in claim 1 wherein said textile finishing composition includes a water-repellent fluorocarbon polymer to enhance wash resistance.

6. A method as defined in claim 5 wherein said textile finishing composition further includes an N-methylol resinous compound to enhance durability of the glass bead particles on the fabric.

7. A method as defined in claim 1 wherein said liquid paste composition further contains a surface active agent to facilitate magnetic reorientation of the reflex-reflective particles under influence of said magnetic force field.

8. A method as defined in claim 1 wherein said glass particles in said liquid paste composition are in sufficient amount to uniformly affix from about 2 to 5 grams of said particles per square yard of fabric surface.

9. A method as defined in claim 2 wherein said glass bead particles are of an average particle size range of between about 200–400 microns.

10. A method as defined in claim 9 wherein said liquid paste composition containing said particles is applied to the surface of said fabric through a printing screen having uniform openings therein of between about 25 to 75 mesh size.

11. A method as defined in claim 2 wherein said liquid paste composition is applied to the surface of the fabric by screen printing the composition thereon through a printing screen having a mesh size of between about one and a half to three times the average size of said glass bead particles dispersed in said liquid paste composition.

* * * * *